US006582107B2

(12) United States Patent
Tsai

(10) Patent No.: US 6,582,107 B2
(45) Date of Patent: Jun. 24, 2003

(54) FOLDABLE LAMPSHADE

(76) Inventor: Ching-Hai Tsai, 2F, No. 23, Lane 68, Min-I St., Lu-Chou City, Taipei Hsien (TW)

( * ) Notice: Subject to any disclaimer, the term of this patent is extended or adjusted under 35 U.S.C. 154(b) by 0 days.

(21) Appl. No.: 09/992,154

(22) Filed: Nov. 6, 2001

(65) Prior Publication Data

US 2003/0086274 A1 May 8, 2003

(51) Int. Cl.[7] ..... F21V 1/06

(52) U.S. Cl. ..... 362/450; 362/351; 362/352; 362/358; 362/357

(58) Field of Search ..... 362/351, 352, 362/358, 450, 361, 357

(56) References Cited

U.S. PATENT DOCUMENTS 5,375,048 A * 12/1994 Barnes ..... 362/352
6,443,601 B1 * 9/2002 Wu ..... 362/352

* cited by examiner

*Primary Examiner*—Thomas M. Sember
*Assistant Examiner*—Anabel Ton
(74) *Attorney, Agent, or Firm*—Pearne & Gordon LLP

(57) ABSTRACT

A foldable lampshade has an upper ring and a lower ring. A plurality of ribs is pivotally mounted between the upper ring and the lower ring. Each rib has an upper arm and a lower arm pivotally mounted together by a pin. A notch is defined at an inner side of the lower arm and near an upper end of the lower arm. A pole is formed near a lower end of the upper arm and located in the notch. A resilient member has a first end secured on the upper arm and a second end secured on the lower arm. A shade covers the upper ring, the lower ring and the ribs.

8 Claims, 7 Drawing Sheets

FOLDABLE LAMPSHADE

BACKGROUND OF THE INVENTION

1. Field of the Invention

The present invention is related to a lampshade, and more particularly to a foldable lampshade.

2. Description of Related Art

Conventional lampshades generally can not be folded and occupy a large space, which is very inconvenient during storage and transportation. Furthermore, the quantity of products in transport is also limited by the size of the lampshade, and the transport cost is accordingly high.

Therefore, the invention provides a foldable lampshade to mitigate and/or obviate the aforementioned problems.

SUMMARY OF THE INVENTION

The main objective of the invention is to provide a foldable lampshade which facilitates convenient and cost-effective storing and transporting of the lampshade.

Other objects, advantages and novel features of the invention will become more apparent from the following detailed description when taken in conjunction with the accompanying drawings.

DETAILED DESCRIPTION OF THE PREFERRED EMBODIMENT

Figure 1:
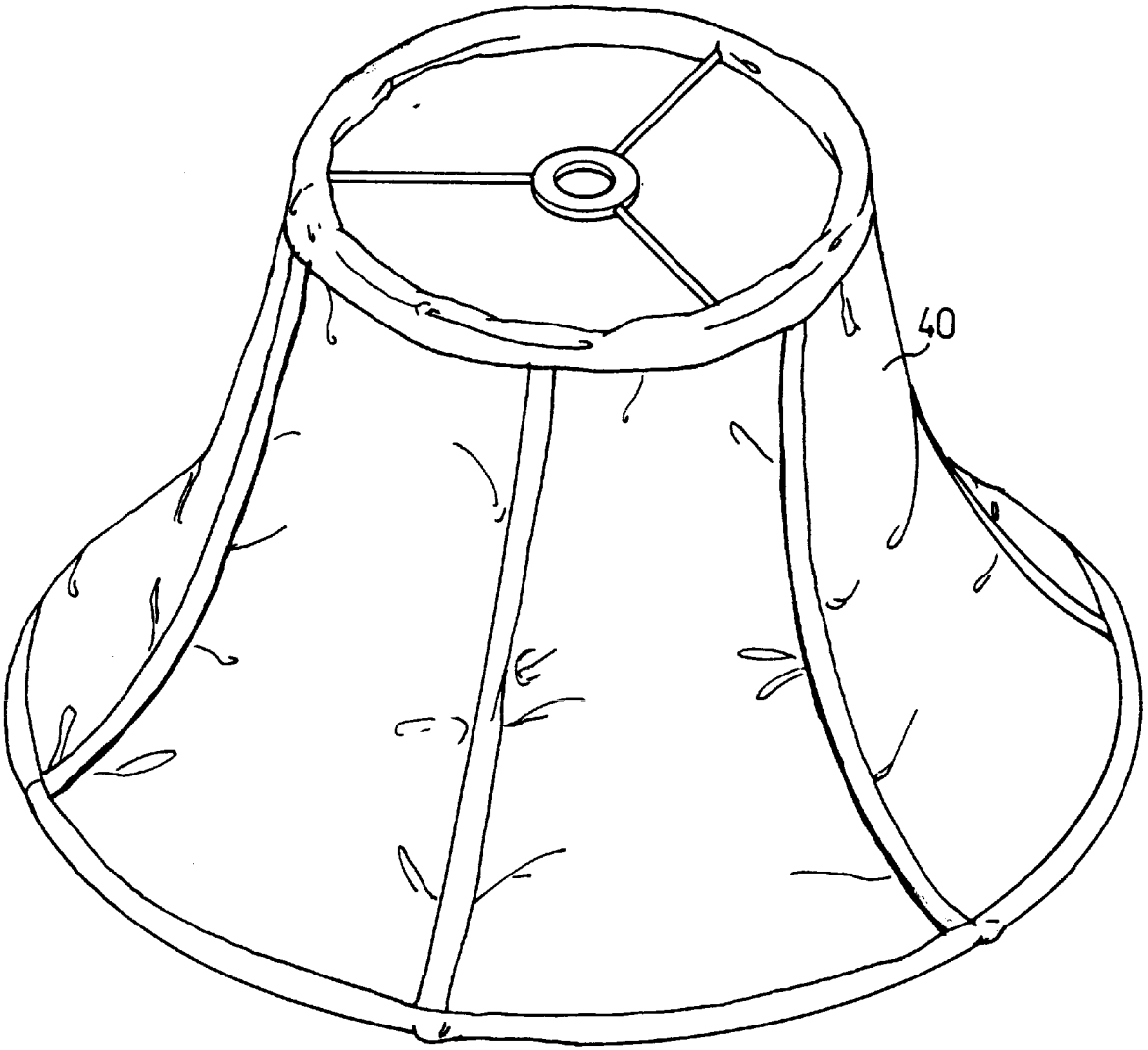
FIG. 1 is a perspective view of a foldable lampshade in accordance with the invention.
Figure 2:
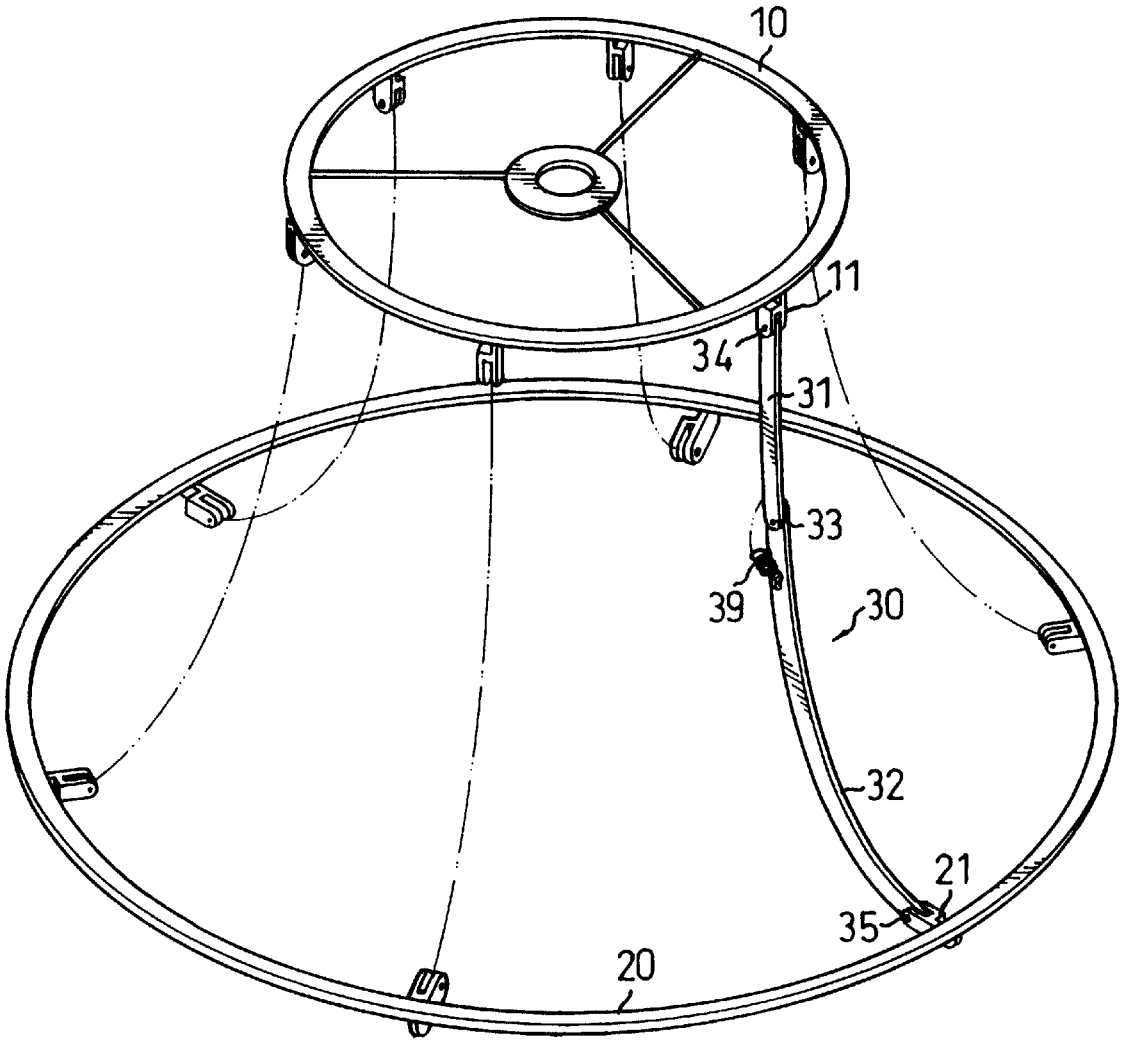
FIG. 2 is a perspective view of the foldable lampshade of FIG. 1 without a fabric shade.

Referring to FIGS. 1 and 2, a foldable lampshade in accordance with the invention is composed of an upper ring (10), a lower ring (20), a plurality of ribs (30) pivotally mounted between the upper ring (10) and the lower ring (20), and a shade (40) covering the upper ring (10), the lower ring (20) and the ribs (30).

The upper ring (10) has a spider (not numbered) provided therein. A plurality of first seats (11) is formed on the upper ring (10) and each first seat (11) has an inverted y-shape with a bottom slot (not numbered). The lower ring (20) has a diameter larger than that of the upper ring (10). A plurality of second seats (21) is formed on the lower ring (20) and each second seat has a y-shape with a top slot (not numbered).

Figure 3:
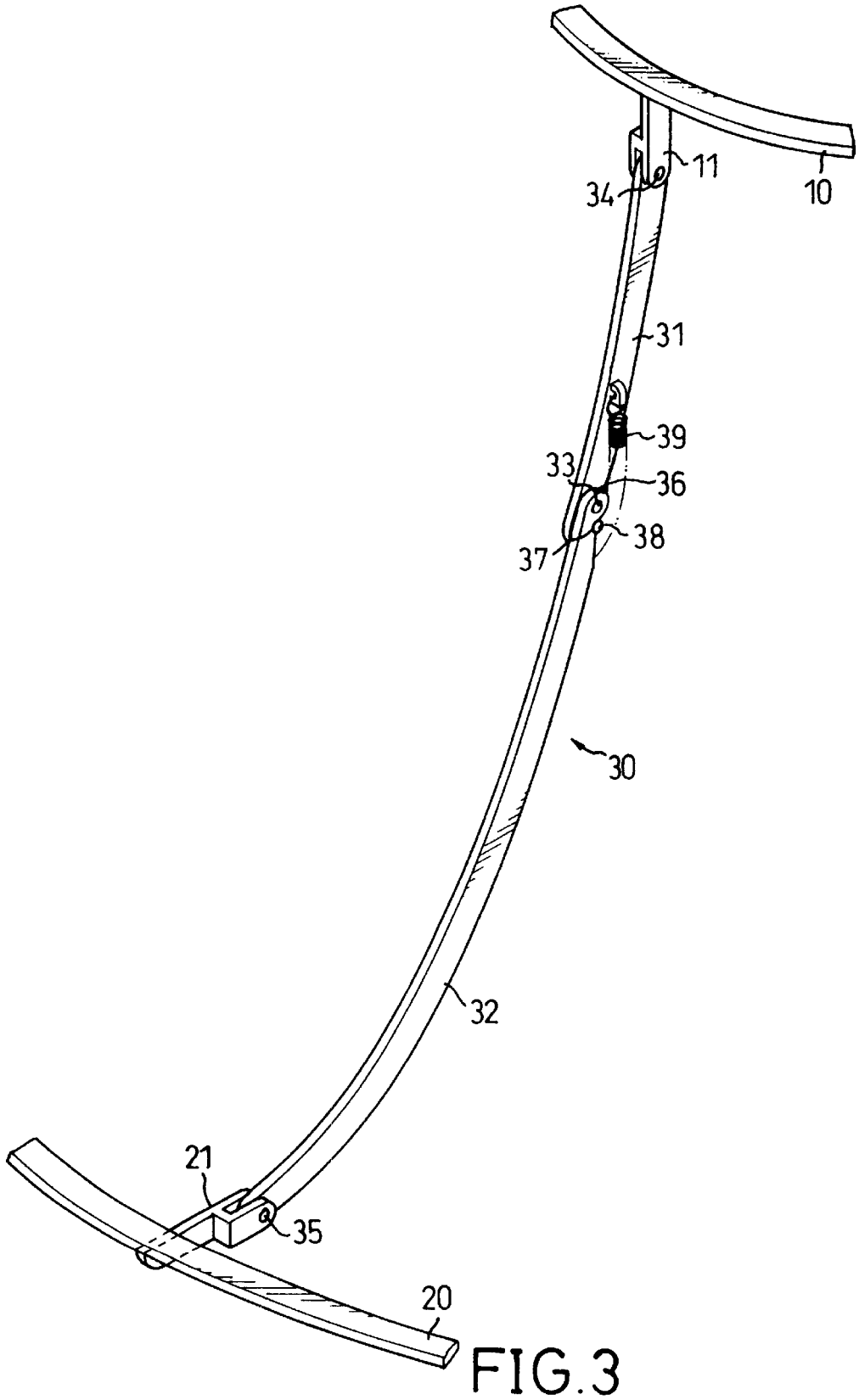
FIG. 3 is a partially perspective view showing a rib between an upper ring and a lower ring.
Figure 4:
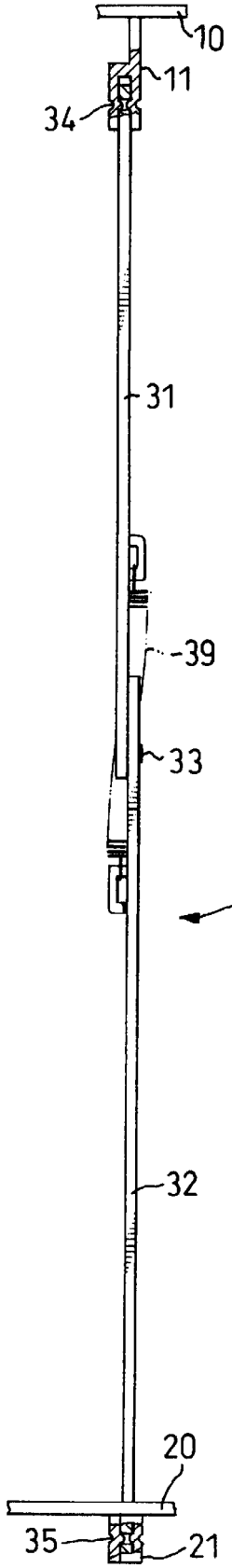
FIG. 4 is a front view of the rib between the upper ring and the lower ring of FIG.3.
Figure 5:
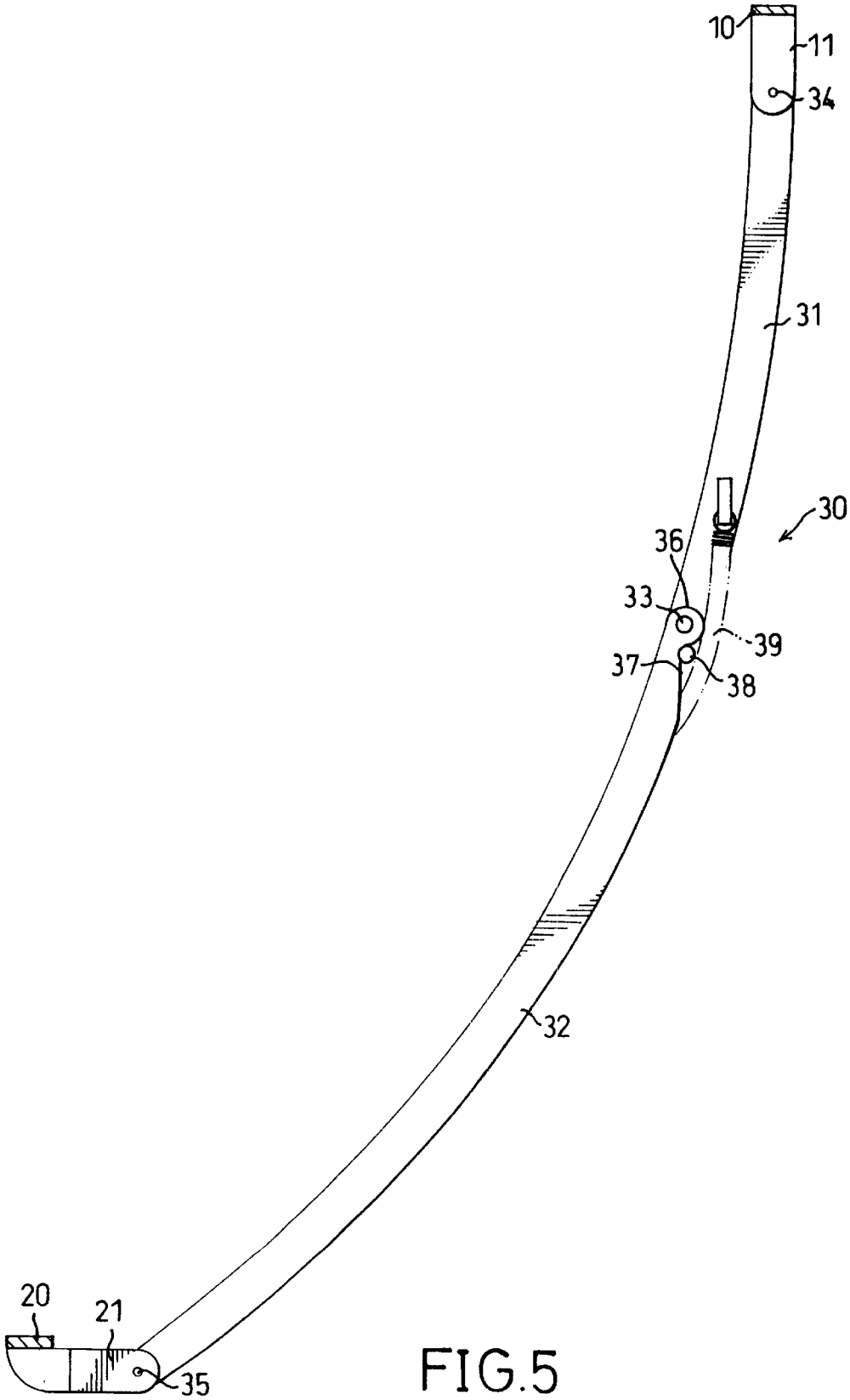
FIG. 5 is a side view of the rib between the upper ring and the lower ring of FIG. 3.

Referring to FIGS. 3–5, the ribs (30) each are composed of an upper arm (31) and a lower arm (32). The upper arm (31) has a lower end pivotally mounted with an upper end of the lower arm (32) by a pin (33). An upper end of the upper arm (31) is pivotally mounted in the first seat (11), and a lower end of the lower arm (32) is pivotally mounted in the second seat (21).

The first seat (11) has two first lugs (not numbered) formed on two opposite inner walls of the bottom slot. The upper end of the upper arm (31) has two first pits (34) defined in two opposite outer faces thereof. The first lugs are respectively received in the pits (34) to pivotally mount the upper arm (31) in the first seat (11).

The second seat (21) has two second lugs (not numbered) formed on two opposite inner walls of the top slot. The lower end of the lower arm (32) also has two second pits (35) defined in two opposite outer faces thereof. The second lugs are respectively received in the pits (35) to pivotally mount the lower arm (32) in the second seat (11).

The upper arm (31) further has a pole (38) formed near the lower end thereof The lower arm (32) further has a notch (37) defined at an inner side thereof and near the upper end thereof. The pole (38) is located in the notch (37) to prevent the upper arm (31) from pivoting inward. The upper end of the lower arm (32) has a rounded head (36) to enable the pole (38) to move along the rounded head (36) and escape from the notch (37) when the upper arm (31) is pivoted outward.

A resilient member (39) has a first end secured on a side wall of the upper arm (31) and a second end secured on a side wall of the lower arm (32) opposed to the side wall of the upper arm (31).

Figure 6:
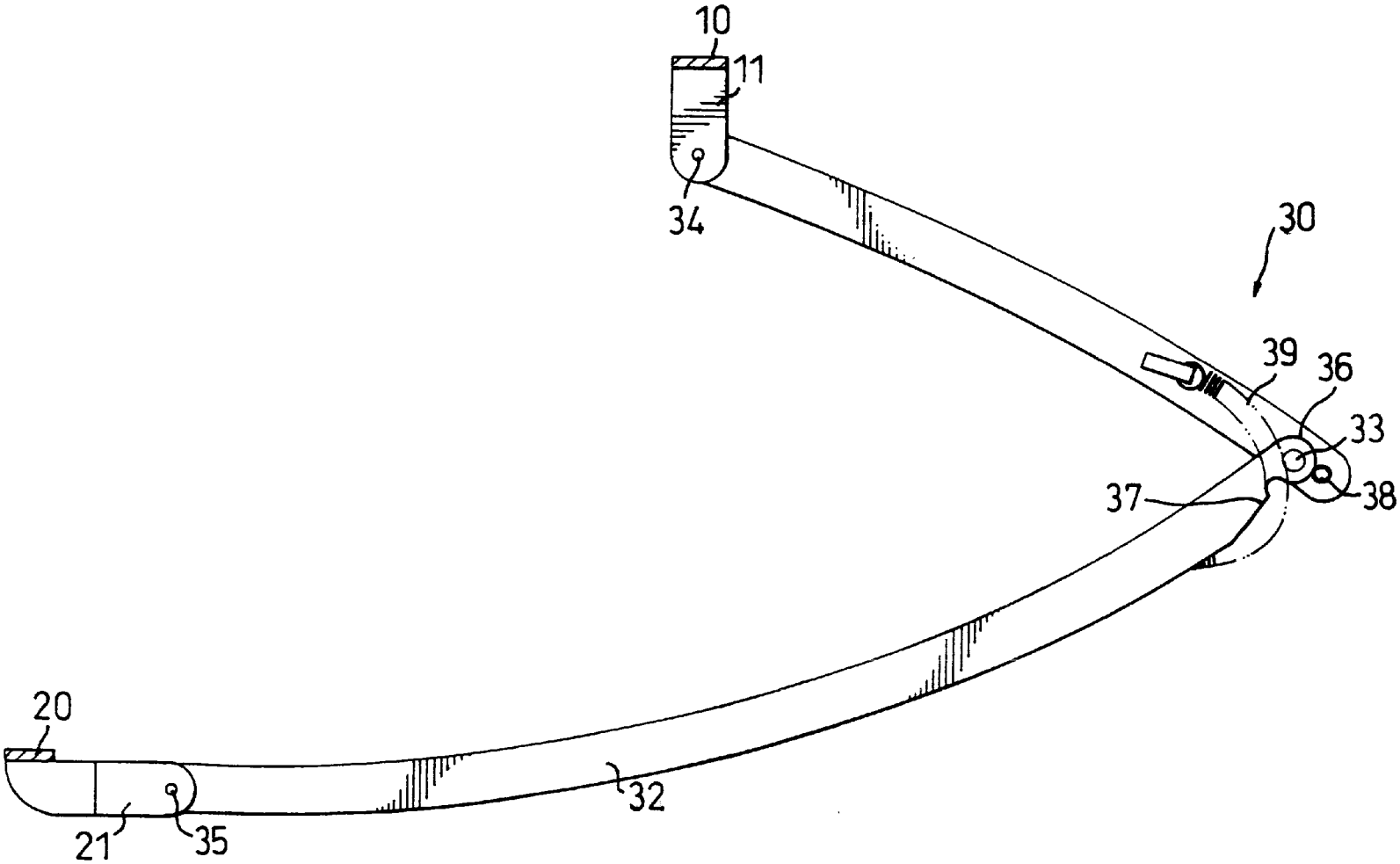
FIG. 6 is a schematic view showing the rib between the upper ring and the lower ring being folded.

Referring to FIG. 6, when the lampshade is folded, the upper ring (10) is pressed down to pivot the upper arm (31) toward the lower arm (32). The pole (38) is moved along the rounded head (36) and escaped from the notch (37) and the resilient member (39) is bent laterally. In this case, the vertical size of the lampshade is reduced and it is very convenient to store and transport the lampshade.

Figure 7:
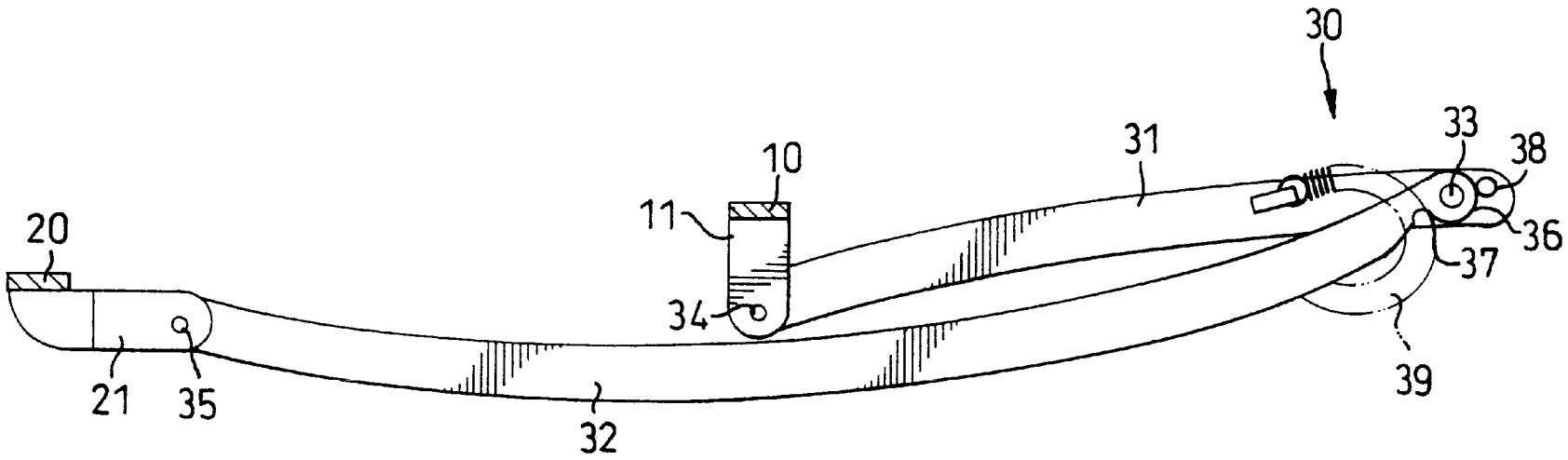
FIG. 7 is a schematic view showing the upper ring being pressed down further.

Referring to FIG. 7, when the lampshade is unfolded, the upper ring (10) is further pressed down to increase the force of the resilient member (39). Therefore, when the upper ring (10) is released, the upper arm (31) can be easily pivoted away from the lower arm (32). The pole (38) is moved along the rounded head (36) to enter the notch (37). Then, the lampshade is unfolded as shown in FIGS. 1 and 2.

Because the lampshade in accordance with the invention can be folded to reduce its size, it is very convenient to store and transport the lampshade. Consequently, the quantity of products in transport is high and the transport cost is low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable lampshade comprising:

an upper ring;

a lower ring;

a plurality of ribs pivotally mounted between the upper ring and the lower ring, each rib having an upper arm and a lower arm pivotally mounted together by a pin, a notch defined at an inner side of the lower arm and near an upper end of the lower arm, a pole formed near a lower end of the upper arm and located in the notch; and a resilient member with a first end secured on the upper arm and a second end secured on the lower arm; and a shade covering the upper ring, the lower ring and the ribs, wherein the upper ring has a plurality of first seat and upper ends of the upper arm are respectively pivotally mounted in the first seats, and the lower ring has a plurality of second seats and lower ends of the lower arms are respectively pivotally mounted in the second seats.

2. The foldable lampshade as claimed in claim 1, wherein each of the first seats has a bottom slot defined therein, two first lugs respectively formed on the opposite inner walls of the bottom slot, and the upper end of the respective upper arm has two first pits defined in two opposite outer faces to receive the first lugs respectively.

3. The foldable lampshade as claimed in claim 1, wherein each of the second seats has a top slot defined therein, two second lugs formed on the opposite inner walls of the top slot, and the lower end of the respective lower arm has two second pits defined in two opposite outer faces to receive the second lugs respectively.

4. The foldable lampshade as claimed in claim 1, wherein the upper ends of the lower arms each have a rounded head to enable the respective poles to move along the rounded head escape from the notch when the upper arms and the lower arms are folded.

5. The foldable lampshade as claimed in claim 1, wherein each first end of the resilient members is secured on a first direction side wall of the respective upper arm, and each second end of the resilient member is secured on a side wall of the respective lower arm and the side wall of the respective lower arms faces a second direction opposed to the first direction side wall.

6. The foldable lampshade as claimed in claim 2, wherein each of the second seats has a top slot defined therein, two second lugs formed on the opposite inner walls of the top slot, and the lower end of the respective lower arm has two second pits defined in two opposite outer faces to receive the second lugs respectively.

7. The foldable lampshade as claimed in claim 6, wherein the upper ends of the lower arms each have a rounded head to enable the respective poles to move along the rounded head and escape from the notch when the upper arms and the lower arms are folded.

8. The foldable lampshade as claimed in claim 7, wherein each first end of the resilient members is secured on a first direction side wall of the respective upper arm, and each second end of the resilient member is secured on a side wall of the respective lower arm and the side wall of the respective lower arms faces a second direction opposed to the first direction side wall.

* * * * *